US011050207B2

(12) United States Patent
Chen et al.

(10) Patent No.: US 11,050,207 B2
(45) Date of Patent: Jun. 29, 2021

(54) CRIMPING APPARATUS AND SYSTEM FOR CRIMPING A FLEXIBLE PRINTED CIRCUIT

(71) Applicant: Securitag Assembly Group Co., Ltd., Taichung (TW)

(72) Inventors: Tung -Sheng Chen, Changhua County (TW); Shih- Ching Chen, Tainan (TW); Chih- Cheng Chuang, Nantou County (TW)

(73) Assignee: Securitag Assembly Group Co., Ltd., Taichung (TW)

( * ) Notice: Subject to any disclaimer, the term of this patent is extended or adjusted under 35 U.S.C. 154(b) by 44 days.

(21) Appl. No.: 16/781,954

(22) Filed: Feb. 4, 2020

(65) Prior Publication Data

US 2020/0176940 A1 Jun. 4, 2020

Related U.S. Application Data

(62) Division of application No. 15/994,543, filed on May 31, 2018, now abandoned, which is a division of (Continued)

(30) Foreign Application Priority Data

Apr. 8, 2015 (TW) ..... 104111190

(51) Int. Cl.
*H01R 43/048* (2006.01)
*H01R 43/042* (2006.01)

(52) U.S. Cl.
CPC ..... *H01R 43/0486* (2013.01); *H01R 43/0427* (2013.01)

(58) Field of Classification Search
CPC ..... H01R 43/0427; H01R 43/0486
See application file for complete search history.

(56) References Cited

U.S. PATENT DOCUMENTS 5,200,601 A 4/1993 Jarvis
5,232,532 A 8/1993 Hori
(Continued)

FOREIGN PATENT DOCUMENTS

CN 100543767 C 9/2009
CN 101933128 B 8/2012
(Continued)

OTHER PUBLICATIONS

Taiwanese Office Action, dated Sep. 21, 2016, in a counterpart Taiwanese patent application, No. TW 104111190.

*Primary Examiner* — Carl J Arbes
(74) *Attorney, Agent, or Firm* — Chen Yoshimura LLP

(57) ABSTRACT

A crimping apparatus comprising a press module connected with a pressing mold, a translation module, and a pressure control module is disclosed. The press module generates an action force on the pressing mold through a fluid. The translation module is coupled to the press module for driving the press module to move toward a flexible printed circuit having two isolated circuit layers such that one circuit layer is pressed to crimp to the other circuit layer, wherein the pressure control module adjusts the pressure within the press module to maintain a constant force on the pressing mold whereby the pressing mold can generate a constant stress acting on the flexible printed circuit during the crimping process. In addition, the crimping apparatus can be adapted in a roll-to-roll process for crimping two isolated circuit layers of each flexible printed circuit unit arranged on the roll.

5 Claims, 5 Drawing Sheets

Related U.S. Application Data application No. 14/805,438, filed on Jul. 21, 2015, now Pat. No. 10,014,641.

(56) References Cited

U.S. PATENT DOCUMENTS

| | | | | |
|---|---|---|---|---|
| 5,387,306 | A | 2/1995 | Jarvis | |
| 5,585,618 | A | 12/1996 | Droz | |
| 5,952,713 | A | 9/1999 | Takahira | |
| 6,412,701 | B1 | 7/2002 | Kohama et al. | |
| 6,992,376 | B2 * | 1/2006 | Jaeck | H01L 23/5387 174/254 |
| 7,421,775 | B2 * | 9/2008 | Kwak | G06K 19/07749 29/600 |
| 8,296,939 | B2 * | 10/2012 | Furuta | H01L 24/83 29/832 |
| 2002/0125044 | A1 * | 9/2002 | Johnson | H01L 23/49822 174/262 |
| 2006/0143898 | A1 | 7/2006 | Kwak et al. | |
| 2010/0085723 | A1 | 4/2010 | Furuta | |
| 2010/0243153 | A1 * | 9/2010 | Onitsuka | H01L 24/75 156/290 |

FOREIGN PATENT DOCUMENTS

| | | | |
|---|---|---|---|
| JP | 2894218 | B2 | 3/1999 |
| JP | 3561478 | B2 | 9/2004 |
| TW | I436700 | B | 5/2014 |
| TW | I445982 | B | 7/2014 |

* cited by examiner

CRIMPING APPARATUS AND SYSTEM FOR CRIMPING A FLEXIBLE PRINTED CIRCUIT

This application claims the benefit of Taiwan Patent Application Serial No. 104111190, filed Apr. 8, 2015, the subject matter of which is incorporated herein by reference.

BACKGROUND OF INVENTION

1. Field of the Invention

The present invention relates to a technique for electrically connecting two mutually isolated circuit layers to each other and, more particularly, to a crimping apparatus and system and method for electrically connecting two mutually isolated circuit layers formed on a flexible printed circuit to each other through mold pressing.

2. Description of the Prior Art

Please refer to FIG. 1A, which illustrates a flexible printed circuit. Generally, the flexible printed circuit 1 comprises an isolation layer 10, a first circuit layer 11, and a second circuit layer 12. The isolation layer 10 is formed from a flexible material and the first and second circuit layers 11 and 12 are respectively formed on upper and bottom surface of the isolation layer 10 whereby the first circuit layer 11 is electrically isolated from the second circuit layer 12. In one specific application, there is a need for electrically connecting the first circuit layer 11 to the second circuit layer 12 which is implemented by a crimping operation where a stress is acted on the flexible printed circuit 1 such that a portion of metal material of the first circuit layer 11 penetrates throughout the isolation layer 10, thereby binding to a portion of metal material of the second circuit layer 12 such that the first circuit layer is electrically connected to the second circuit layer 12.

In the conventional art, the crimping process is performed by using a resilient element for storing a resilient force by which the mold pressing can be operated. Thereafter, the resilient force is released for driving a mold to press the flexible printed circuit 1 whereby the first circuit layer 11 formed on the upper surface of the isolation layer 10 is penetrated throughout the isolation layer 10 and electrically connected to the second circuit layer 12 formed on the bottom surface of the isolation layer 10. In one operation embodiment, such as roll-to-roll manufacturing process, since a plurality of flexible printed circuits are sequentially arranged on the flexible substrate, it is necessary to control a plurality of resilient elements for simultaneously performing the crimping process on the plurality flexible circuits respectively corresponding to the plurality of resilient elements. It is well known that the key for performing crimping process toward a plurality of flexible printed circuits simultaneously is the compression control of the resilient elements, i.e., the height of the pressing mold. However, a compression control for ensuring each resilient element to possess the same compression magnitude at the same time so as to generate the same resilient force for mold pressing is difficult. Accordingly, the consequence of crimping process using resilient elements will induce unstable of electrical conduction between the first and second circuit layers 11 and 12 as well as will cause the difficulties of the same compression magnitude of each resilient element adjusted and tuned by the engineers.

It is also known that the crimping quality depends on the stability control of the compressive stress exerted on the flexible printed circuit 1 during crimping process. If the compressive stress is insufficient, such as the illustration shown in FIG. 1B, the binding force between the first and second circuit layers 11 and 12 is not enough thereby causing circuit layer 11 to break away from the circuit layer 12 in the subsequent manufacturing process and, finally, it will become a defect within the product of the flexible printed circuit after the roll-to-roll manufacturing process. On the contrary, if the compressive stress is excessively applied to the flexible printed circuit, such as the condition shown in FIG. 1C, a damaged portion 13 is easily generated thereby affecting the binding strength and the electrical conduction between the first and second circuit layers 11 and 12. In addition, since there a damaged portion 13 on the flexible printed circuit 1, the upper and bottom molds will mutually contact with each other during the crimping process thereby causing the upper mold to rub against the bottom mold directly so as to reduce the lifetime of the mold.

Accordingly, there is a need for a crimping apparatus and system and method that is insensitive to the pressing height of mold press and to the influence of pressed material and is also easily adjusted by the user for electrically connecting two mutually isolated circuit layers to each other thereby solving the conventional problem of the crimping process.

SUMMARY OF THE INVENTION

The present invention provides a crimping apparatus and system and method for crimping the flexible printed circuit in which a fluid pressure is converted into an action force acting on the pressing mold and the pressing mold is driven to move by a translation module for pressing an object with a constant stress. By means of controlling the fluid pressure, the action force or stress acting on the object during the press procedure can be kept constant thereby generating better quality of crimping result. In addition to preventing the flexible printed circuit from being pressed by excessively applied action force, thereby generating damaged structures, the present invention further prevents friction between the pressing molds, e.g. upper mold and bottom mold, so as to extend the lifetime of pressing mold.

In one embodiment, the present invention provides a crimping apparatus, comprising a pressure module, a pressing mold, a translation module, and a pressure control module. The pressure module is configured to provide a pressure through a fluid. The pressing mold is connected to the pressure module for receiving the pressure provided from the pressure module. The translation module is connected to the pressure module for moving the pressure module toward an object whereby the pressing mold is moved to press the object. The pressure control module is configured to control the pressure of the fluid within the pressure module when the pressing mold presses the object so that an action force that the pressing mold acts on the object is kept constant.

In another embodiment, the present invention further provides a crimping system, comprising a roll-to-roll conveying module for conveying a flexible substrate roll, at least one pressure control module, and a plurality of crimping apparatus. The roll-to-roll conveying module has a plurality of flexible printed circuits formed thereon, and each flexible printed circuit comprises an isolation layer, a first circuit layer formed on an upper surface of the isolation layer, and a second circuit layer formed on a bottom surface of the isolation layer. Each crimping apparatus is configured to correspond to one of the flexible printed circuit and comprises a pressure module, a pressing mold, and a translation module. The pressure module is configured to provide a pressure through a fluid. The pressing mold is connected to the pressure module for receiving the pressure from the pressure module. The translation module is connected to the pressure module for moving the pressure module toward the corresponding flexible printed circuit so as to move the pressing mold to press the flexible printed circuit thereby causing the first circuit layer to penetrate throughout the isolation layer and connect to the second circuit layer. The at least one pressure control module is configured to control the pressure of the fluid within each the pressure module when the pressing mold presses the flexible printed circuit so that an action force that the pressing mold acts on the flexible printed circuit is kept constant.

In a further embodiment, the present invention further provides a method for crimping a flexible printed circuit. At first, at least one flexible printed circuit and a crimping system are provided, wherein each flexible printed circuit comprises an isolation layer, a first circuit layer formed on an upper surface of the isolation layer, and a second circuit layer formed on a bottom surface of the isolation layer and the crimping system comprises at least one crimping apparatus respectively corresponding to the at least one flexible printed circuit, each crimping apparatus further comprising a pressure module, a pressing mold coupled to the pressure module, and a translation module. The crimping system further comprises at least one pressure control module for controlling a fluid flowing into the pressure module. After that, a step of controlling the translation module of each crimping apparatus to move the pressure module thereof toward the corresponding flexible printed circuit is performed thereby leading the pressing mold to press the corresponding flexible printed circuit. Finally, a step of controlling the pressure generated by the fluid inside the pressure module is performed whereby an action force generated by the pressing mold is kept constant during the pressing mold pressing the flexible printed circuit such that the first circuit layer penetrates throughout the isolation layer and electrically connects to the second circuit layer.

All of these objectives achieved by the crimping apparatus and system and method for electrically connecting two mutually isolated circuit layers formed on a flexible printed circuit to each other are described below. The accompanying figures are schematic and are not intended to be drawn to scale. In the figures, each identical, or substantially similar component that is illustrated in various figures may be represented by a single numeral or notation (though not always). For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a crimping apparatus and system and method for crimping a flexible printed circuit using the same. In the following description, numerous details are set forth in order to provide a thorough understanding of the present invention. It will be appreciated by one skilled in the art that variations of these specific details are possible while still achieving the results of the present invention. In other instances, well-known components are not described in detail in order not to unnecessarily obscure the present invention.

Figure 1A:
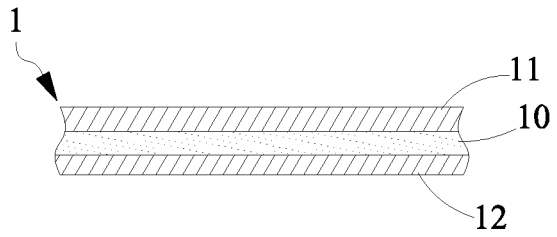
FIG. 1A illustrates schematic view of a flexible printed circuit.
Figure 1B:
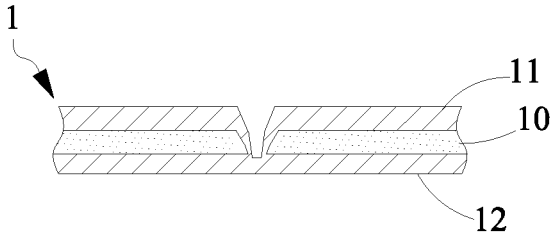
FIGS. 1B and 1C illustrate a schematic view of defective flexible printed circuit after crimping process.
Figure 1C:
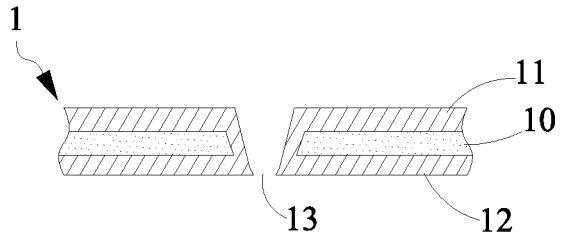
Figure 2:
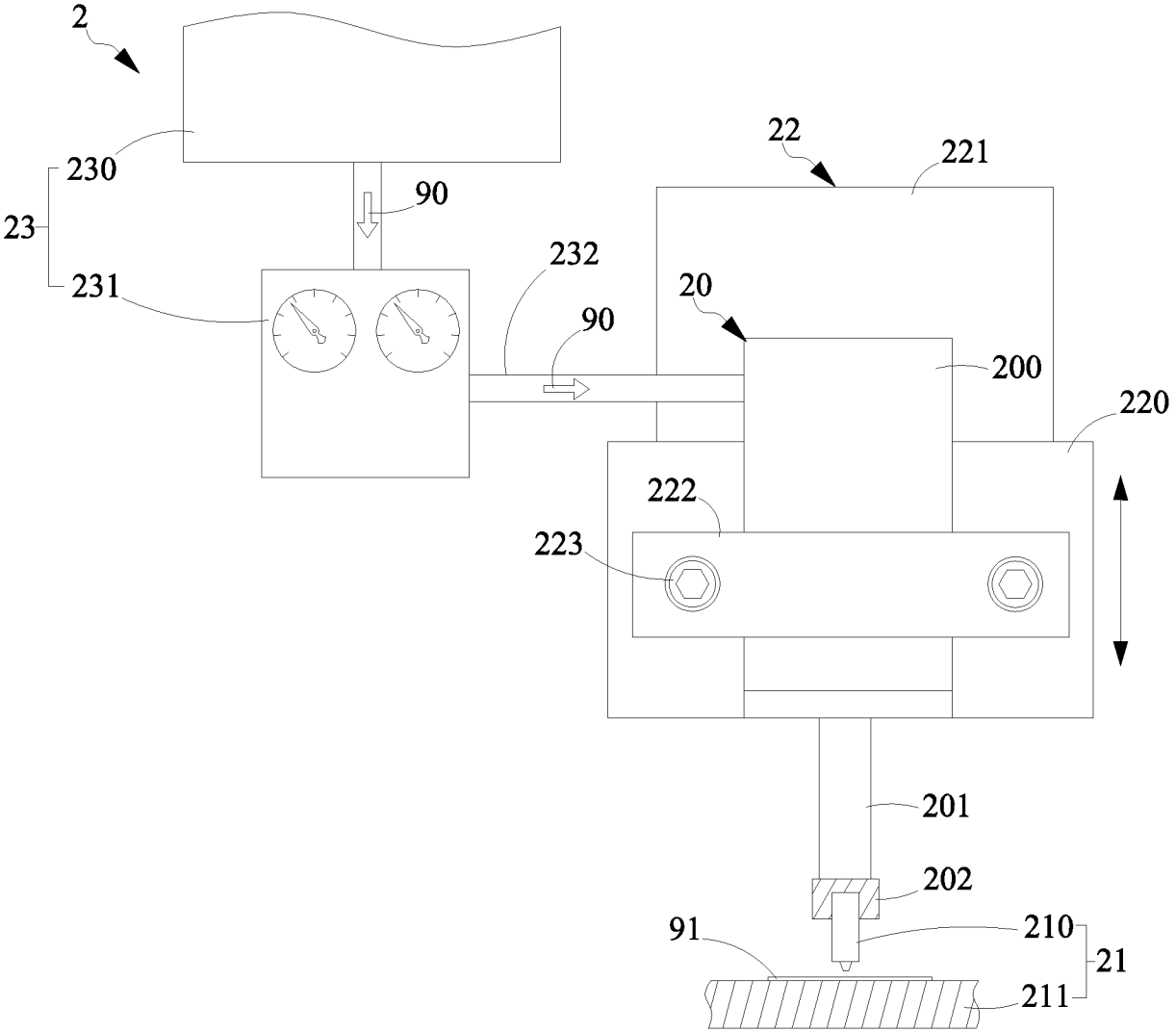
FIG. 2 illustrates one embodiment of the crimping apparatus according to the present invention.

Please refer to FIG. 2, which illustrates one embodiment of the crimping apparatus according to the present invention. In the present embodiment, the crimping apparatus 2 comprising pressure module 20, pressing mold 21, translation module 22 and a pressure control module 23. The pressure module 20 provides pressure through a fluid flowing therein. In one embodiment, the pressure module 20 is a cylinder assembly coupled to the pressing mold 21. In the present embodiment, the cylinder assembly comprising a pressure cylinder 200 and a piston rod 201, wherein the pressure cylinder 200 has an accommodating space for allowing the fluid 90 flowing therein. The pressing mold 21 is coupled to the pressure module 20 through the piston rod 201. A portion of the piston rod 201 is accommodated inside the pressure cylinder 200 and one end of the piston rod 201 is coupled to the pressing mold 21 through a clamping element 202. The pressure generated by the fluid inside the pressure cylinder 200 is converted into force acting on the piston rod 201 whereby the force is further transmitted to the pressing mold 21. It is noted that the cylinder assembly is a known art in the related field, which will not be described further hereinafter.

In the present invention, the pressing mold 21 further comprises an upper mold 210 and a bottom mold 211, in which the upper mold 210 is coupled to the piston rod 201 of the pressure module 20 whereas the bottom mold 211 is at a specific distance away from the upper mold 210 for supporting an object 91 corresponding to the upper mold 210. In one embodiment, the object 91 is a flexible printed circuit. It is noted that there has no specific limitation on the profile of the pressing mold 21 and it is designed according to the user's need so that the mold is not limited to the present described embodiment having upper mold and bottom mold but instead may be variously embodied according to the actual needs.

The pressure control module 23, in one embodiment, comprises a pressure source 230 and an adjusting device 231. The pressure source 230 is configured to provide fluid 90, which can be liquid such as oil liquid, or gas, such as air, which can be properly selected according to the actual need. In the present embodiment, the fluid 90 is a gas. Correspondingly, the pressure cylinder 200 can be a single-acting cylinder or double-acting cylinder, wherein, in the present embodiment, the pressure cylinder 200 is a single-acting cylinder. In addition, the adjusting device 231 respectively coupled to the pressure module 20 and pressure source 230 through pipes 232 for adjusting the fluid amount flowing into the pressure module 20 whereby the force acting on the piston rod 201 converted from the pressure inside the pressure module 20 can be controlled by the adjusting device 231 and transmitted to the pressing mold 21. It is noted that the pressure range required for generating the action force can be implemented by using, but is not be limited to, pressure gauge or any mechanical or electrical control valves, which can be properly designated by the user according to the actual need.

The translation module 22 comprises a base 220 and a driving unit 221. The base 220 is coupled to the pressure module 20. In the present embodiment, a clamping element 222 is arranged on the base 220 for claiming and fastening the pressure module 20 on the base 220 through fasteners 223 such as, for example, a combination of bolt and nut. It is noted that the clamping element is not limited to the embodiment shown in the present invention. The one having ordinary skilled in the art can determine the proper means for claming and fastening the pressure module 20 on the base 220 according to the actual need.

It is noted that, in the embodiment shown in FIG. 2, since the adjusting device 231 is coupled to the pressure module 20 through pipes 232, which are flexible, the driving unit 221 can move the pressure module 20 upward or downward. Furthermore, in one alternative embodiment, the adjusting device 231 is integrated with the pressure module 20 thereby moving upward or downward with the movement of the pressure module 20. The connection between the pressure module 20 and the adjusting device 231 can be varied according the actual need so it is not limited by the embodiment shown in FIG. 2. It is also noted that, in one embodiment, the arrangement between the pressure control module 23 and pressure module 20 can be one-to-one relationship or, alternatively, one-to-many relationship, i.e., a single pressure control module 23 controlling a plurality of pressure modules 20.

Figure 3A:
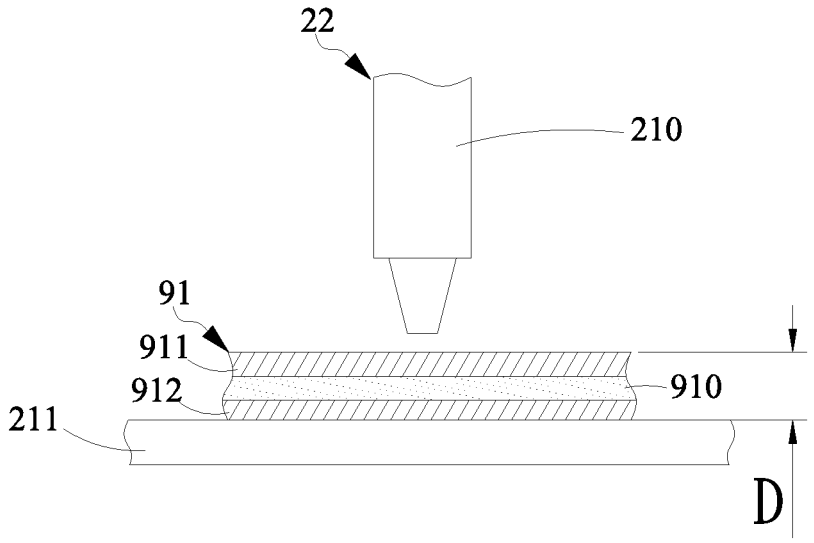
FIGS. 3A to 3D respectively shown flow of a crimping process for the flexible printed circuit according to the present invention.

Next, please refer to FIGS. 2 and 3A to 3D, which illustrates an operation procedure of the present invention. Firstly, as shown in FIG. 3A, an object is provided. In the present embodiment, the object is a flexible printed circuit 91 having an isolation layer 910, a first circuit layer 911 and a second circuit layer 912 wherein the first circuit layer 911 is formed on the upper surface of the isolation layer 910 while the second circuit layer 912 is formed on the bottom surface of the isolation layer 910. The first circuit layer 911 and second circuit layer 912 is formed by metal material with electrically conducting capability, which can be, but is not limited to, alumni, copper, gold, or alloys thereof. Furthermore, in one embodiment, the flexible printed circuit 91 is a radio frequency identification (RFID) device, in which the first circuit layer 911 and the second circuit layer 912 can be, but is not limited to, an antenna circuit or bridge circuit of the RFID, such as a combination of RFID chip and passive components, e.g., capacitor, resistor, inductor, and etc. In the present embodiment, the first circuit layer 911 is the antenna circuit of the RFID while the second circuit layer 912 is the bridge circuit. The material for making the isolation layer 910 can be, but is not limited to, polypropylene (PP), polyethylene terephthalate (PET), or polyethylene (PE). In one embodiment, the thickness of the object, i.e., the flexible printed circuit 91, is less than or equal to 100 μm. The pressure control module 23 controls and adjusts the pressure inside the pressure module 20 simultaneously so that the force transmitted to the pressing mold 21 is kept constant whereby the action force or stress that the pressing mold 21 acts on the flexible printed circuit 91 is kept constant during the crimping process.

Figure 3B:
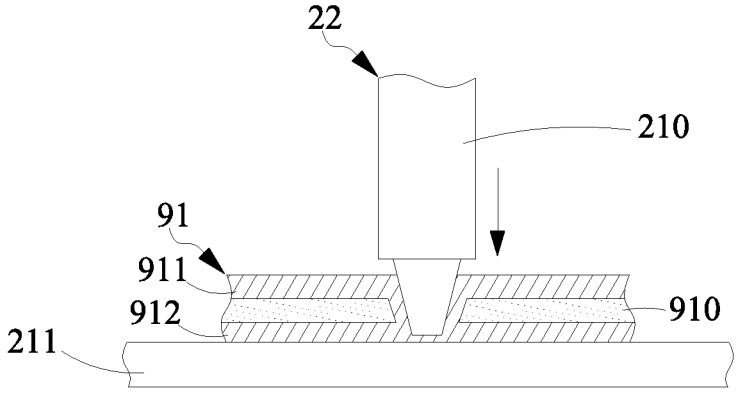
Figure 3C:
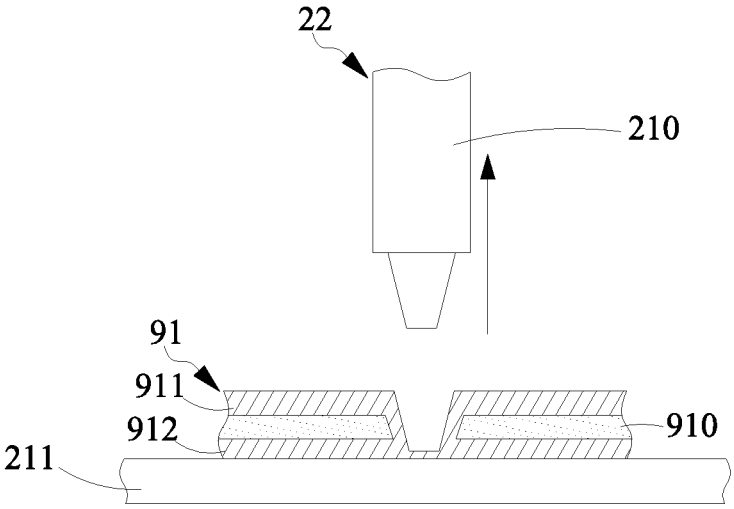
Figure 3D:
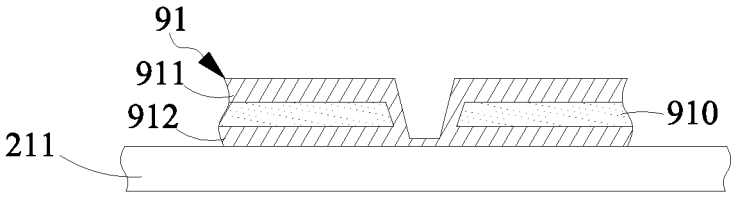

Next, as shown in FIG. 3B, the translation module 22 is controlled to drive the pressure module 20 to move toward the flexible printed circuit 91 such that the front part of the pressing mold 21 presses the flexible printed circuit 91. In the present embodiment, the upper mold 210 continues to press the flexible printed circuit 91 such that the isolation layer 910 is broken by the stress or action force received from the pressing mold while the first circuit layer 911 is deformed to penetrate throughout the isolation layer 910 thereby electrically connecting to the second circuit layer 912. It is noted that, during the press process, the pressure controlling module 23 detects the fluid pressure inside the pressure module 20 and controls the fluid amount flowing into the pressure module 20 from pressure source 230 thereby keeping the action force acting on the pressing mold 21 constant so as to provide constant pressing stress acting on the flexible printed circuit 91 from the upper mold 210. After pressing downward on the flexible printed circuit 91 a certain of distance, as shown in FIG. 3C, the translation module 22 moves the upper mold 210 upward and the flexible printed circuit 91 will become the structure shown in FIG. 3D. From FIG. 3D, it is clear that the first circuit layer 911 penetrates throughout the isolation layer 910 and electrically connects to the second circuit layer 912.

Please refer back to FIG. 2, it is known that the conventional pressure cylinder 200 is usually utilized to be an actuator for moving the piston rod 201 outward from the cylinder 200 and backward to the cylinder 200 periodically through the filling or releasing of fluid inside the cylinder 200; however, differing from the usage of the conventional pressure cylinder, the pressure cylinder 200 actuates the piston rod 201 to fixedly extend at a specific distance without moving the piston rod back and forth. Regarding the control of moving piston rod 201, it is performed by the control of the translation module 22 to move the pressure module 20 forward (downward) and backward (upward) rather than control the piston rod 201 to move forward from the cylinder 200 or backward to return the pressure cylinder 200. Since the translation module 22 is utilized to control the movement of the pressing mold 21 acting on the flexible printed circuit 91 and the action force, converted from the pressure and transmitted to the pressing mold 21, is kept constant by adjusting the fluid pressure inside the pressure module 20 through the pressure control module 23, the stress or reaction force acting on the object can be maintained constant during the crimping process whereby the unstable stress or reaction force acting on the object during the crimping process can be effectively improved.

Figure 4:
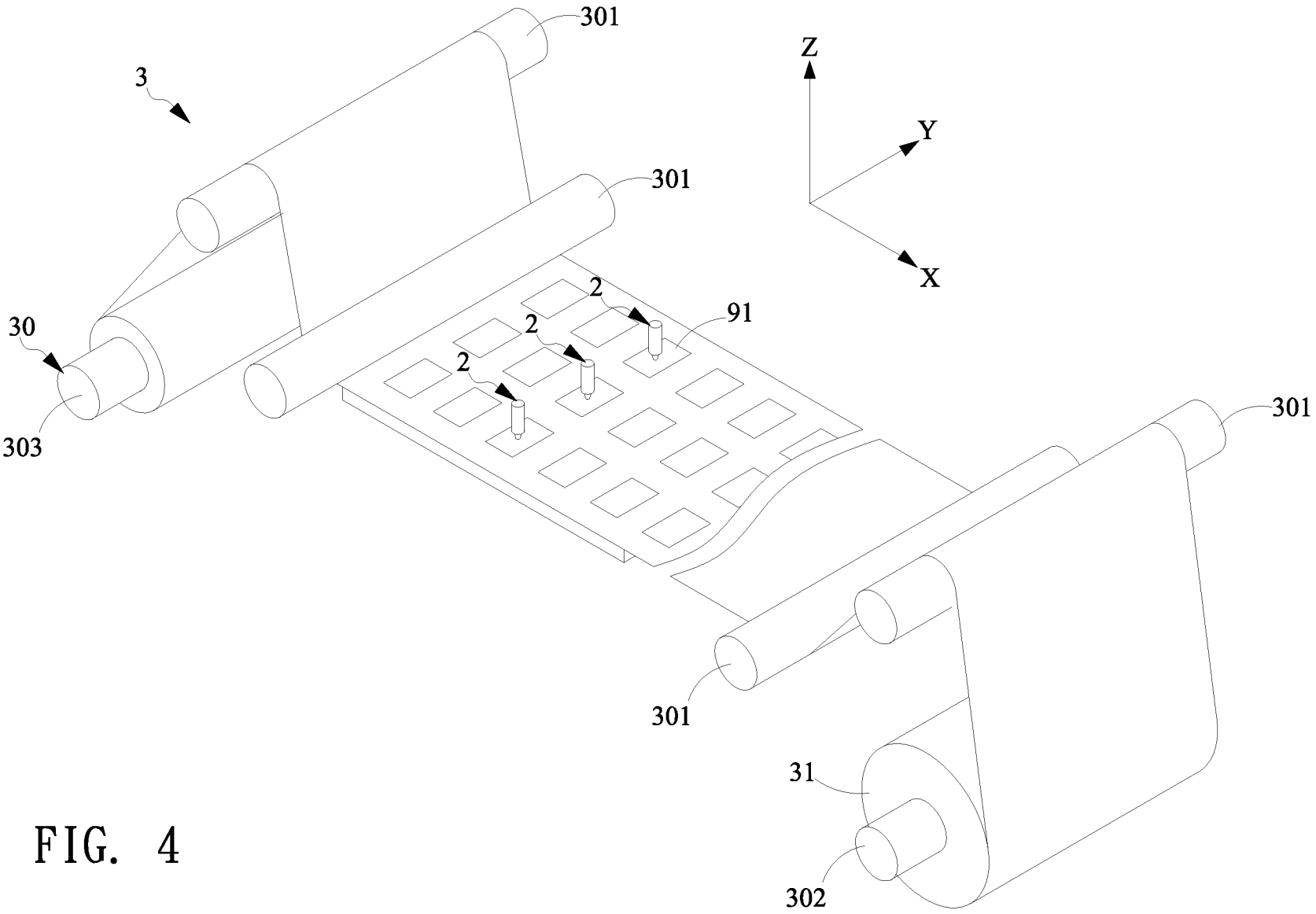
FIG. 4 illustrates one embodiment of roll-to-roll crimping system according to the present invention.

In another embodiment, the crimping apparatus can be further applied in a roll-to-roll process for forming a crimping system shown in FIG. 4. In the present embodiment, the crimping system 3 comprises a roll-to-roll transportation module 30 for transporting a flexible substrate roll 31 on which a plurality of flexible printed circuits 91 are formed. Each flexible printed circuit 91, as shown in FIG. 3A, comprises an isolation layer 910 having an upper and bottom surfaces on a first circuit layer 911 and a second circuit layer 912 are respectively formed. In one embodiment, a thickness of each flexible printed circuit 91 is less than or equal to 100 μm. The roll-to-roll transportation module 30 comprises a plurality of rollers 301, 302, and 303 including at least one steering roller and a plurality of driven rollers, wherein a roller 302 carries the flexible substrate roll 31. One end of the flexible substrate roll 31 is coupled to the roller 303 utilized to receive the flexible substrate roll 31 passing through the plurality of rollers 301.

In the present embodiment, since the surface area of the flexible substrate roll 31 is large, a plurality of crimping apparatuses 2 such as the embodiment shown in FIG. 2, for example, can be arranged along the width direction of the flexible substrate roll 31, each of which is corresponding to a flexible printed circuit 91 formed on the flexible substrate roll 31. By means of the transportation of the flexible substrate roll 31 through the roll-to-roll transportation module 30 along the X direction, each crimping apparatus 2 performs crimping process toward the flexible printed circuit 91 passing there through, thereby making one circuit layer to penetrate throughout the isolation layer and connecting to the other circuit layer. It is noted that, as shown in FIGS. 2 and 4, a pressure control module 23 has one-to-one relationship to pressure module 20 for each crimping apparatus 2; alternatively, the pressure control module 23 has one-to-many relationship to the pressure modules 20, i.e., a single pressure control module for controlling and adjusting the pressure of the pressure module of each crimping apparatus arranged within the crimping system 3. In addition to the crimping apparatus shown in the FIG. 4, it is noted that there can be arranged any necessary processing stage along the roll-to-roll transportation direction X in the crimping system 3.

Accordingly, the crimping apparatus, crimping system and method for crimping the flexible printed circuit in the present invention are capable of providing constant action force or stress that the pressing mold presses on the object during the crimping process whereby one circuit layer is pressed to penetrate throughout the isolation layer and electrically connect to the other circuit layer which is formerly isolated from the pressed circuit layer without generating defects so that not only can the electrical connection between two circuit layers be greatly improved but also the pressing mold can be protected from being rubbed thereby increasing the usage lifetime of the pressing mold.

While the present invention has been particularly shown and described with reference to a preferred embodiment, it will be understood by those skilled in the art that various changes in form and detail may be without departing from the spirit and scope of the present invention.

What is claimed is:

1. A method for crimping a flexible printed circuit, comprising:

forming at least one flexible printed circuit, each of which comprising an isolation layer, a first circuit layer formed on an upper surface of the isolation layer, and a second circuit layer formed on a bottom surface of the isolation layer, wherein a thickness of the flexible printed circuit is less than or equal to 100 μm;

forming a crimping system comprising at least one pressure control module, and at least one crimping apparatus respectively corresponding to the at least one flexible printed circuit, each crimping apparatus further comprising a pressure module, a pressing mold coupled to the pressure module, and a translation module;

controlling the translation module of each crimping apparatus to move the pressure module thereof toward the corresponding flexible printed circuit thereby moving the pressing mold to press the corresponding flexible printed circuit such that the first circuit layer penetrates throughout the isolation layer and connects to the second circuit layer; and controlling the pressure generated by the fluid inside the pressure module by the pressure control module whereby an action force generated by the pressing mold is kept constant during the pressing mold pressing the flexible printed circuit.

2. The method of claim 1, wherein the at least one flexible printed circuit is formed on a flexible substrate roll.

3. The method of claim 1, the translation module further comprising:

a base, connected to the pressure module; and a driving unit, connected to the base for driving the base to move.

4. The method of claim 1, the pressure control module further comprising:

a pressure source, configured to provide the fluid; and an adjusting device, respectively coupled to the pressure module and the pressure source for adjusting and controlling the fluid entering pressure module, wherein the pressure generated by the fluid inside the pressure module is controlled by the adjusting device thereby the action force is kept constant during the pressing mold pressing the flexible printed circuit.

5. The method of claim 1, the pressure module further comprising:

a pressure cylinder, coupled to the pressure control module and the translation module; and a piston rod, coupled to the pressure cylinder and the pressing mold.

* * * * *